United States Patent [19]

Du Shane

[11] 4,054,791

[45] Oct. 18, 1977

[54] PORTABLE LANTERN WITH HIGH SPEED ROTATORY BEAM

[76] Inventor: Harold P. Du Shane, 1774 Greenwood Ave., Trenton, N.J. 08609

[21] Appl. No.: 547,705

[22] Filed: Feb. 6, 1975

[51] Int. Cl.[2] ..... F21M 7/00

[52] U.S. Cl. ..... 362/35

[58] Field of Search ..... 240/49, 24, 10.6, 11.2 R; 340/50, 87

[56] References Cited

U.S. PATENT DOCUMENTS

| | | | |
|---|---|---|---|
| 2,719,282 | 9/1955 | Roth | 240/49 X |
| 2,748,371 | 5/1956 | Wilcox et al. | 240/49 X |
| 2,814,029 | 11/1957 | McRea | 240/49 X |
| 2,846,663 | 8/1958 | Heehler et al. | 240/49 X |
| 3,266,014 | 8/1966 | Leotta | 240/49 X |
| 3,764,799 | 10/1973 | Schulz | 240/49 X |
| 3,866,032 | 2/1975 | Veres | 240/48 X |

*Primary Examiner*—R. L. Moses
*Attorney, Agent, or Firm*—Franklyn Schoenberg

[57] ABSTRACT

A portable lantern comprising a housing having a transparent lens section, an electric light source mounted within said housing, reflector means rotatably mounted within the transparent section of said housing and disposed to project light emitted by said electric light through the transparent section of said housing in a substantially horizontal beam of increased intensity, means for continuously rotating said reflector means at a speed so that a light beam is projected thereby in a circular pattern through said transparent section at a frequency which produces the effect of continuous illumination, and battery power means for energizing said electric light source and reflector rotating means arranged within said housing, said portable lantern being suitable for providing substantially continuous illumination over a large area.

9 Claims, 4 Drawing Figures

PORTABLE LANTERN WITH HIGH SPEED ROTATORY BEAM

The present invention relates to an improved portable lantern and, more particularly, to a portable lantern that is capable of illuminating a large area.

Portable electric lighting devices such as the many types of flashlights and lanterns that are widely used by sportsmen, motorists and for numerous commercial and residential applications, provide a strong directional beam of light, but are generally not suitable for providing general illumination where regular sources of electric power are not available. The battery power source that is generally used with such portable devices limits the amount of illumination that is provided, and when various reflector and/or special lamp devices are employed to increase the intensity of the illumination, the lighting provided is usually projected in a narrow, concentrated beam.

In accordance with the present invention, it has been discovered that a portable lantern comprising in combination; a housing having a transparent peripheral lens section; an electric light source mounted within said housing; reflector means rotatably mounted within the transparent section of said housing and disposed to project light emitted by said light source into a strong, substantially horizontal beam through the transparent section of said housing; means for continuously rotating said reflector means at a speed so that the light beam is projected thereby in a circular pattern through said transparent section at a frequency which produces the effect of continuous illumination to the human eye; and electric power means arranged within said housing for energizing said light source and said reflector rotating means, will provide general illumination of increased intensity for a large area.

The novel portable lantern of the present invention, wherein a rotating reflector means projects a beam of light in a circular pattern and preferably simultaneously concentrates the light emitted by a light source and projects a beam of light of increased intensity in a circular, substantially horizontal pattern, provides illumination of increased luminosity over a large area, rather than in a single direction. By the phenomenon of persistence of vision of the human eye, the entire area traversed by the rotating beam of light, when rotation of the light projecting reflector means approaches or exceeds about 600 revolutions per minute, has the same apparent intensity of illumination that any segment of the circular area traversed would have if lighted by a beam of light projected by a stationary reflector. The threshold of discrimination of the human eye, and the approximate one-tenth of a second after-image on the retina, creates the impression that an apparent steady, intensified beam of light is being projected over the area illuminated by light projected by the rotating reflector.

The present invention will become more fully apparent from the following description and the accompanying drawings in which.

Figure 1:
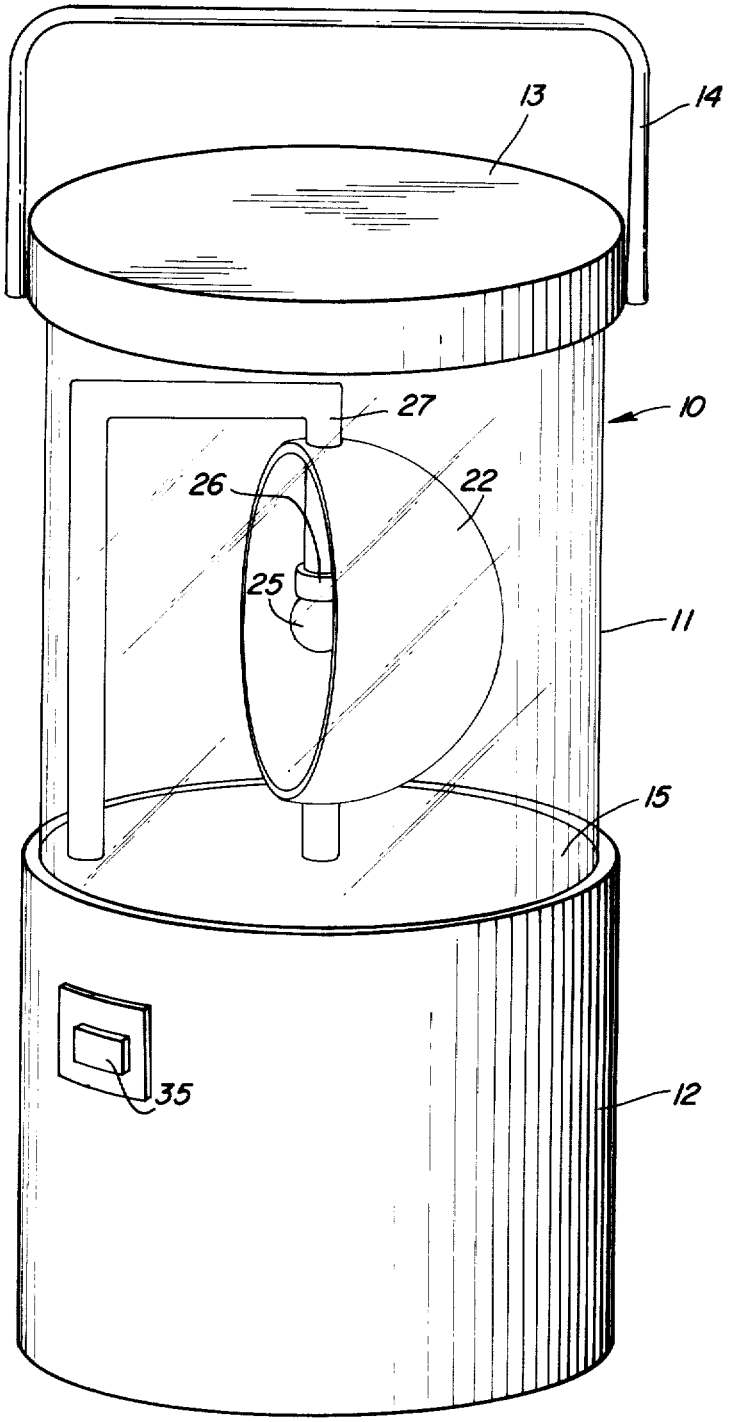
FIG. 1 is a perspective view of a hand lantern embodying the present invention.
Figure 2:
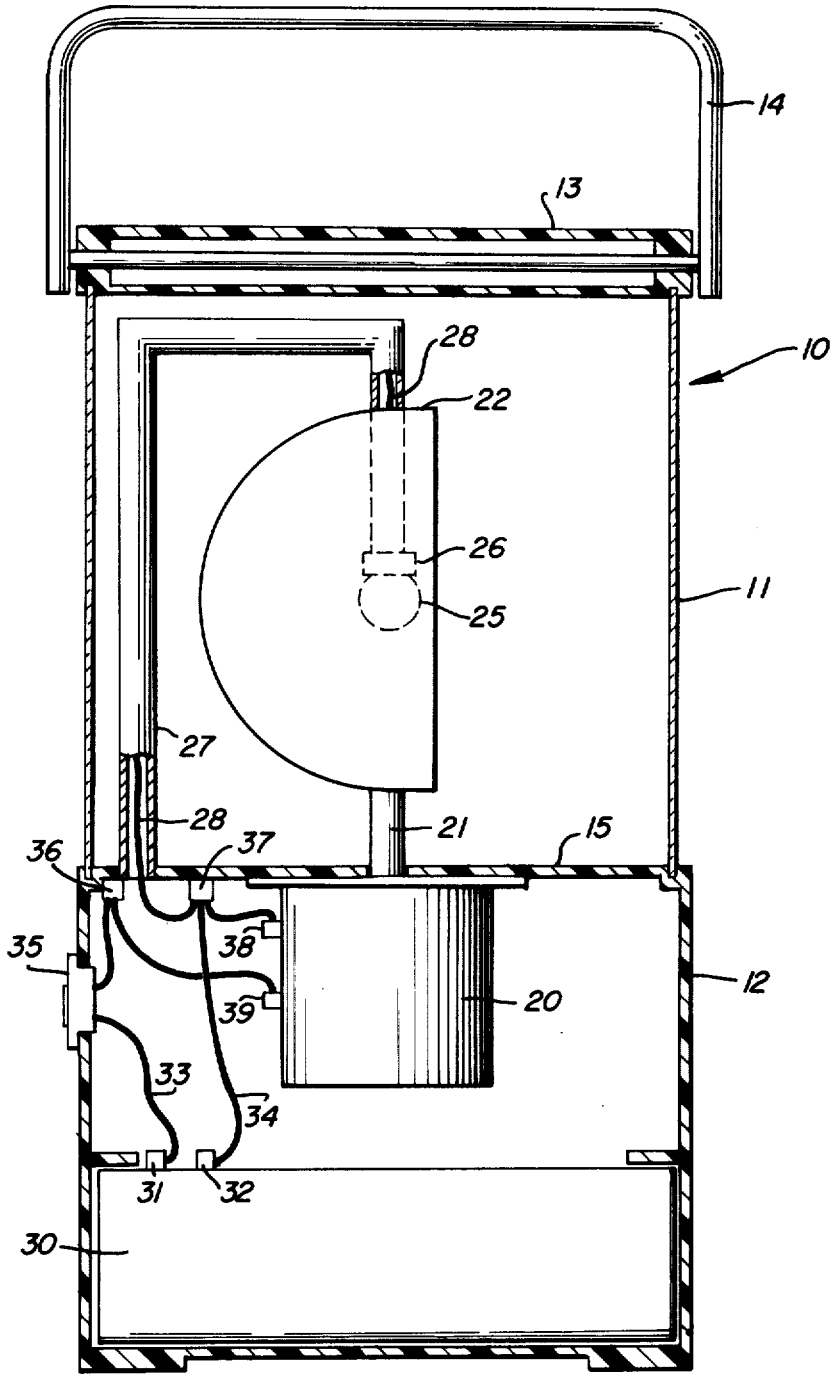
FIG. 2 is a diagrammatical sectional elevation view of the hand lantern of FIG. 1.

Referring now to FIGS. 1 and 2 wherein like reference numerals denote like parts, there is illustrated a hand lantern shown generally as 10 having a substantially cylindrical housing with a transparent lens section 11 removably secured to a base section 12, and a cover 13 removably mounted over the transparent lens section 11. A handle 14 is pivotally secured to the cover 13. An electric motor 20 is secured to the bottom side of pivotally mounted cover plate 15 of base section 12 and is provided with a motor shaft 21 which is journaled through the cover plate 15 and extends into the transparent lens section 11 where a reflector 22 is secured to the end thereof.

As shown, the reflector 22 is a parabolic reflector that is disposed to concentrate and intensify the light beam emitted by a lamp bulb 25 and direct it through the lens 11. The reflector 22 being secured to motor shaft 21 is thereby revolvable about the axis of the lamp bulb 25. THe lamp bulb 25 is mounted in the socket 26 secured to conductive bracket 27 which is mounted on the top side of cover plate 15 and extends to pass through the top of reflector 22. Wire 28 is connected to the socket 26 to energize the lamp bulb 25 mounted therein.

Mounted within the base section 12 is a battery unit 30 holding a plurality of replaceable dry cells, a replaceable dry cell unit package, or a rechargeable dry cell unit package. Contact elements 31 and 32 are provided that make contact with the dry cell unit 30 and through flexible conductors 33 and 34 are connected to manually operated switch 35 and conductive contact strips 36 and 37 that are secured to base section 12. Conductive bracket 27 and wire 28 connects the lamp socket 26 and lamp 25 through contact strips 36 and 37 and switch 35 to battery contacts 31 and 32.

It will be seen in FIGS. 1 and 2, that manually operated switch 35 controls the energization of lamp bulb 25 and motor 20 which results in light from the lamp 25 being concentrated into a beam of increased intensity by reflector 22, and said beam of increased intensity being projected through the full 360° periphery of lens 11 as the motor 20 rotates reflector 22 about the lamp bulb 25. When reflector 22 is rotated at a speed of at least that which corresponds to the inherent persistence of vision of the human eye such as, for example, at a speed of about 600 revolutions per minute or greater, a high intensity beam of light is projected by the reflector over a full 360° that, to the human eye, will appear to be continuous illumination of a substantially greater area than would be illuminated by the same lantern employing a stationary reflector. It will of course be recognized that the operation of the lamp and motor may be independently controlled so that the hand lantern of the invention may be used to illuminate a large area as herein described, or as a directional beam of light if desired, and further, that the speed of rotation of the motor may be varied as desired.

In an alternate embodiment, the lamp 25 mounted in a socket 26 may be supported on an extension of motor shaft 21 which is made hollow to permit flexible conductor means to be connected therewith to energize the lamp, or on a hollow shaft mounted interiorly of a hollow motor shaft. The lamp 25 may be mounted so that it rotates with the motor shaft and reflector means, or the lamp may be stationary with the reflector means rotating thereabout. Preferably, the axis of rotation for the reflector means should be centered through the filament of the lamp, which will minimize the effect of centrifugal force on the filament of a rotating bulb as well as other elements of the rotating assembly.

Figure 3:
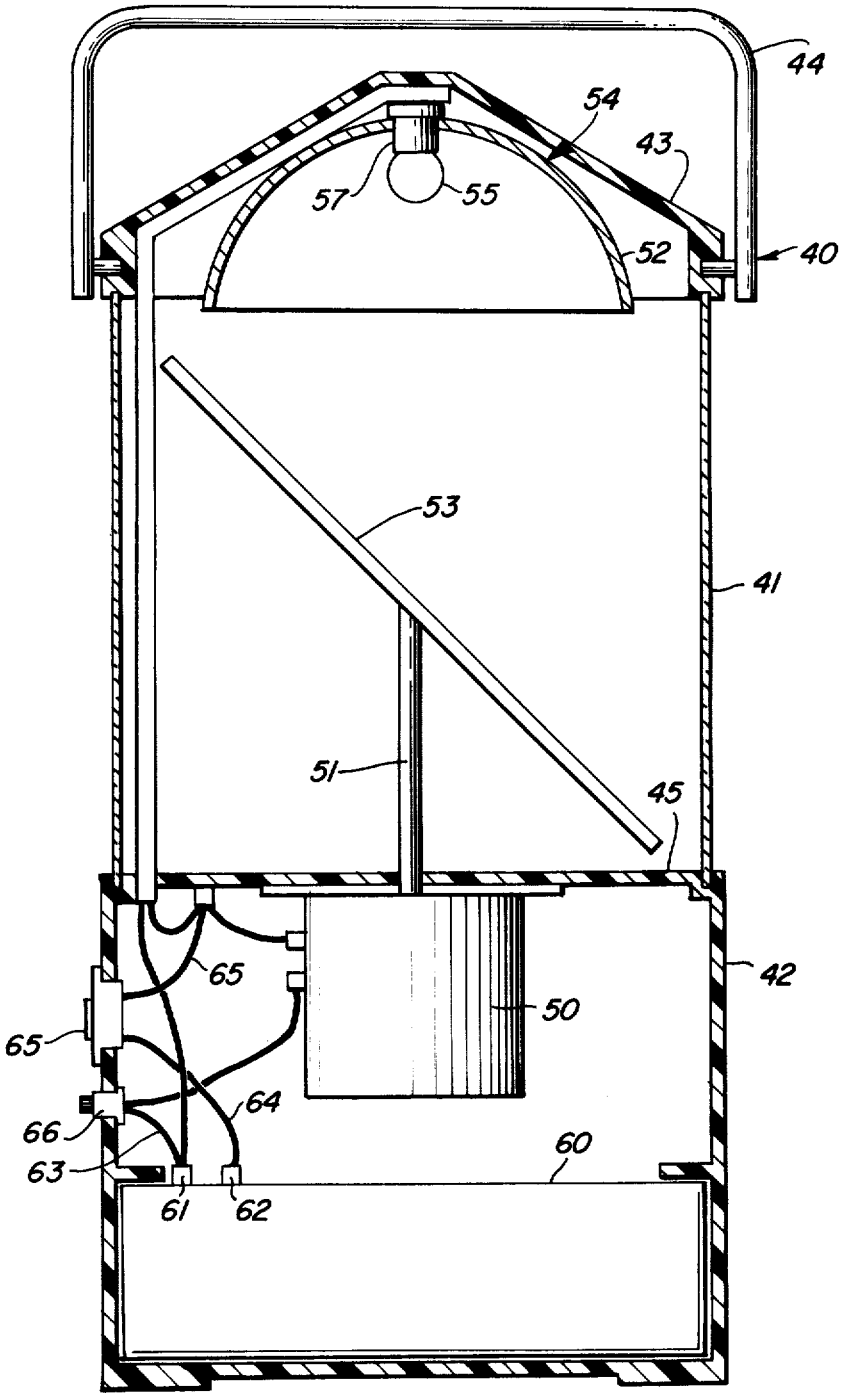
FIG. 3 is a diagrammatical sectional elevation view of an alternate embodiment of the hand lantern of the present invention.
Figure 4:
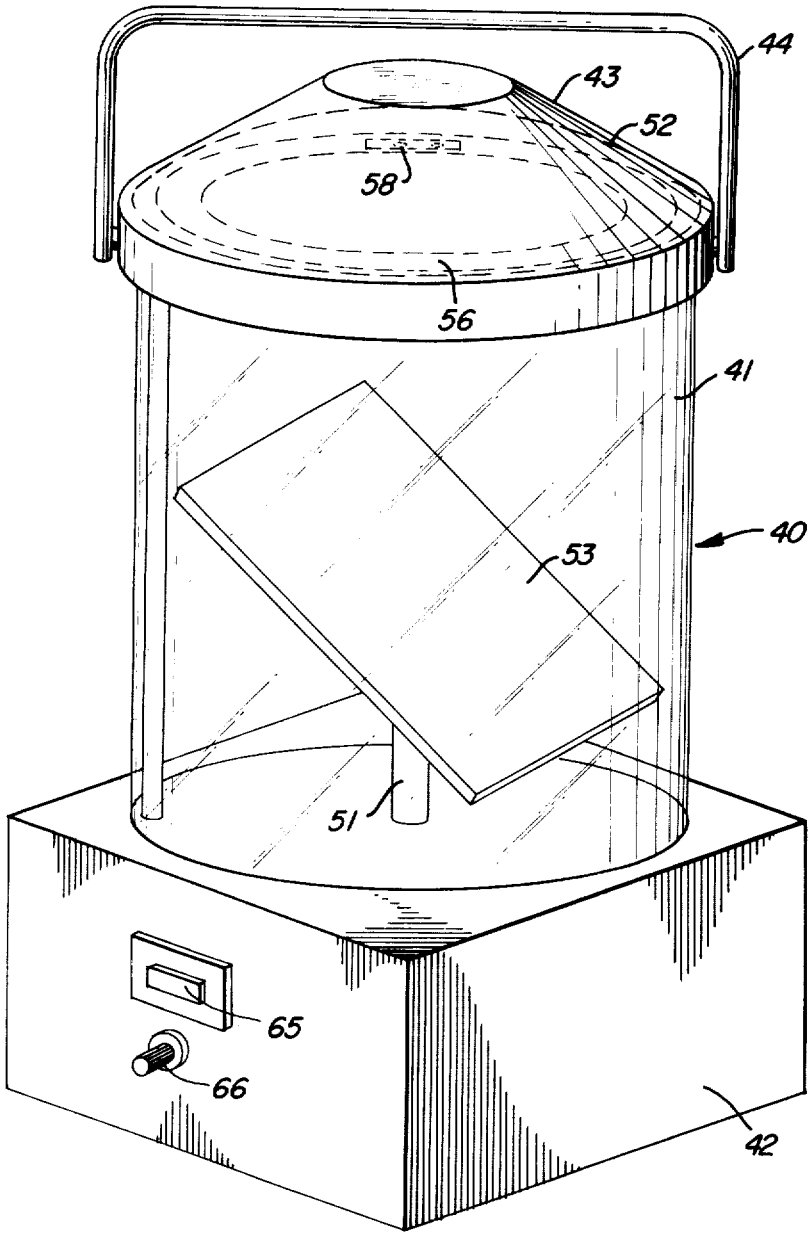
FIG. 4 is a perspective view, parts in section, of an alternate embodiment of the hand lantern of the present invention.

Referring now to FIGS. 3 and 4, there are illustrated alternate embodiments of the hand lantern of the invention wherein a lamp assembly 54 comprising a reflector 52, lamp holder 57 and lamp bulb 55, as shown in FIG. 3 or reflector 52, fluorescent tube holder 58, and round fluorescent tube 56, as shown in FIG. 4, is mounted within the hood or cover section 43 of the hand lantern shown generally as 40. The hood section 43 with a handle 44 pivotally secured thereto is removably mounted over a transparent lens section which is removably secured to a base section 42. As shown, the reflector 52 is a parabolic or similarly shaped reflector that will concentrate and intensify the light from lamp 55 or fluorescent tube 56.

Mounted within the base section 42 is a motor 50 that is secured to the bottom side of pivotally mounted base section cover plate 45 with a motor shaft 51 journaled through the cover plate 45 and extending into the lens section 41. A flat reflector mirror 53 is obliquely secured to the motor shaft 51 and disposed at an angle to intercept light from the light assembly 54 and project the light through the transparent lens section 41. The flat reflector 53 and motor shaft are supported by means well known in the art, to permit continuous rotation thereof at the rotation speed of the motor 50. A battery unit 60 that may comprise a plurality of dry cells, a dry cell unit package, or a rechargeable dry cell unit package is mounted within the base section. Battery contact elements 61 and 62 are provided that make contact with battery unit 60 and, through flexible conductors 63 and 64, to lamp switch 65, motor speed control 66, motor 50 and lamp assembly 54.

In the embodiments shown in FIGS. 3 and 4, if the flat reflector 53 is rotated about an axis through the center of the reflector in lamp assembly 54, the concentrated and intensified beam of light from lamp assembly 54 will be intercepted and projected from the flat reflector 53 through the full 360° periphery of the lens section 41. When the reflector 53 is rotated at a sufficiently high speed, as herein described, the frequency with which the light beam is projected in all directions will be great enough to have effect on the human eye of continuous illumination.

The portable hand lantern of the present invention is suitable to provide general illumination for a larger area and of greater intensity than would be obtained from portable hand lanterns employing a stationary reflector or a lantern device that does not employ any reflector. The effect of continuous illumination is obtained by employing a rotating reflector means that projects light in a full circle about the lantern at a high enough frequency to exceed the threshold of discrimination of the human eye, and the increased intensity of such illumination results from the use of suitable reflector means that will concentrate and intensify the light from the particular light source employed.

It will be understood that the size and type of reflector and motor means; that the type of light source; portable electric energy source, and construction of the various elements of the hand lantern may be varied as desired for different applications. However, general illumination of a greater area and of greater intensity is obtained from the portable hand lantern of the present invention than will be obtained from portable hand lanterns known in the art that employ energy sources and lighting elements of substantially greater capacity.

What is claimed is:

1. A portable lantern suitable for providing general illumination of increased intensity for a large area comprising in combination:

a. a portable lantern housing having a base section upon which said housing is independently supported and a transparent lens section removably secured thereto, said lens section having cover means removably secured thereto;

b. an electric light source mounted within the transparent lens section of said housing;

c. reflector means rotatably mounted for rotation at a continuous speed of at least about 600 revolutions per minute within the transparent section of said housing and disposed to project a concentrated, intensified beam of light from said light source into a substantially horizontal beam through the full 360° periphery of said transparent lens section;

d. motor means mounted within said base section of said housing with the shaft thereof extending into said transparent lens section being connected to said rotatable reflector means for continuously rotating said reflector means about the axis of said motor shaft at a speed of at least about 600 revolutions per minute and projecting light through said transparent section in a circular pattern about said lantern at a frequency that exceeds the threshold of discrimination of the human eye and provides continuous general illumination for a large area about said lantern;

e. electric power means arrange within said housing for energizing said light source and said reflector means; and f. electric switch means mounted on said housing for said electric light source and said reflector rotating means.

2. A portable lantern as claimed in claim 1 wherein said reflector means concentrates and intensifies light from said electric light source.

3. A portable lantern as claimed in claim 1 which includes a reflector separate from said rotatable reflector means that concentrates and intensifies light from said electric light source and projects said intensified beam of light onto said rotatable reflector means.

4. A portable lantern as claimed in claim 1 wherein said electric light source is mounted within the cover means of said transparent lens section.

5. A portable lantern as claimed in claim 4 wherein said electric light source includes a reflector disposed to concentrate and intensify light from light source and project a concentrated beam of light onto said rotatable reflector means.

6. A portable lantern as claimed in claim 1 wherein said electric switch means saparately control said electric light source and said reflector rotating means.

7. A portable lantern as claimed in claim 1 wherein said rotatable reflector means comprises a parabolic reflector that concentrates and intensifies the light from said light source and that is mounted with the axis of rotation thereof about said electric light source.

8. A portable lantern as claimed in claim 7 wherein said rotatable reflector means and said electric light source concurrently rotate with the axis of rotation thereof being centered through the filament of said electric light source.

9. A portable lantern as claimed in claim 1 including means for varying the speed of rotation of said motor means.

* * * * *